US008683981B2

(12) United States Patent
Uryu et al.

(10) Patent No.: US 8,683,981 B2
(45) Date of Patent: Apr. 1, 2014

(54) FUEL SUPPLY SYSTEM

(75) Inventors: Takuya Uryu, Chiyoda-ku (JP); Yoshihiko Onishi, Chiyoda-ku (JP); Tatsuya Ikegami, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 330 days.

(21) Appl. No.: 13/044,078

(22) Filed: Mar. 9, 2011

(65) Prior Publication Data

US 2012/0097273 A1 Apr. 26, 2012

(30) Foreign Application Priority Data

Oct. 26, 2010 (JP) ..... 2010-239747

(51) Int. Cl.
*F02M 37/08* (2006.01)
*F02M 37/04* (2006.01)

(52) U.S. Cl.
USPC ..... 123/497; 123/456

(58) Field of Classification Search
USPC ..... 123/497, 495, 514, 511, 512, 457, 458, 123/456, 510
See application file for complete search history.

(56) References Cited

U.S. PATENT DOCUMENTS 6,971,373 B2 * 12/2005 Mudway et al. ..... 123/497
7,392,794 B2 7/2008 Hazama
2002/0148445 A1 * 10/2002 Doane et al. ..... 123/458
2003/0183205 A1 * 10/2003 Mudway et al. ..... 123/497
2005/0188958 A1 * 9/2005 Klenk et al. ..... 123/458
2005/0205065 A1 * 9/2005 Rembold et al. ..... 123/446
2007/0221173 A1 9/2007 Hazama

FOREIGN PATENT DOCUMENTS

JP 08-158971 A 6/1996
JP 11-236861 A 8/1999
JP 11-280584 A 10/1999
JP 2002-106400 A 4/2002
JP 2003-293883 A 10/2003
JP 2005-069120 A 3/2005
JP 2007-255281 A 10/2007

OTHER PUBLICATIONS

Japanese Office Action dated Aug. 28, 2012 issued in a corresponding Japanese Patent Application No. 2010-239747.

* cited by examiner

*Primary Examiner* — Mahmoud Gimie
(74) *Attorney, Agent, or Firm* — Sughrue Mion, PLLC

(57) ABSTRACT

A fuel supply system includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, wherein the low pressure fuel pump and high pressure fuel pump are configured in such a way as to be driven or stopped independently of each other, one by each motor, and the pressure of the fuel discharged from the high pressure fuel pump is made variable by a combination of the drive or stop of the low pressure fuel pump and the drive or stop of the high pressure fuel pump.

12 Claims, 3 Drawing Sheets

FUEL SUPPLY SYSTEM

BACKGROUND OF THE INVENTION

1. Technical Field

The present invention relates to a fuel supply system which supplies fuel to an internal combustion engine.

2. Related Art

In recent years, an improvement in fuel efficiency of an internal combustion engine (hereafter called an engine) has been requested because of environmental issues, but as a fuel supply system which supplies fuel to the engine, among heretofore known apparatus, there is a fuel supply system arranged in such a way as to inject fuel into an inlet port of an engine (for example, refer to Patent Document 1), and a fuel supply system arranged in such a way as to directly inject fuel into a cylinder of an engine (for example, refer to Patent Documents 2 and 3).

The heretofore known apparatus shown in Patent Document 1 is configured of a motor-driven fuel pump (for example, a Wesco type fuel pump) in a fuel tank, a pressure adjustment device, and a fuel injection valve, and fuel from the fuel pump is adjusted to a constant pressure by the pressure adjustment device, and supplied to the fuel injection valve.

The heretofore known apparatus shown in Patent Document 2 is configured of a motor-driven fuel pump (for example, a Wesco type fuel pump) in a fuel tank, a pressure adjustment device, a high pressure fuel pump driven by a cam attached to a cam shaft of an engine, a solenoid valve which controls the amount of fuel suctioned into the fuel pump, and a fuel injection valve, and by controlling a discharge amount of the high pressure fuel pump with respect to an injection amount of the fuel injection valve, a fuel pressure is optionally adjusted and fuel is supplied to the fuel injection valve.

The heretofore known apparatus shown in Patent Document 3 is arranged in such a way that two motorized fuel pumps are connected in series, and fuel is supplied to an engine by only the upstream side pump, and that a control fuel pressure is set variably by on/off controlling the downstream side pump.

Patent Document 1: JP-A-11-280584
Patent Document 2: JP-A-8-158971
Patent Document 3: JP-A-2007-255281

The heretofore known apparatus shown in Patent Document is one which realizes a low-cost fuel supply system, but as the fuel pressure is of a constant value, there is a limit to an atomization and flow range of fuel injected from the fuel injection valve.

Meanwhile, the heretofore known apparatus shown in Patent Document 2 is such that it carries out a control of the fuel injected from the fuel injection valve to an optimum particle size and injection amount by controlling the fuel pressure to a high pressure and a variable pressure, but as a fuel pressure sensor is needed in a fuel pipe, the high pressure fuel pump is fixed to the engine, and so on, there are many places to be changed on the engine side, leading to a high cost. Also, as a condition is such that the fuel pump is always driven even when an engine load fluctuates, the drive loss of the fuel pump is large, and there has been a problem in that a drive loss of the fuel pump when the engine load decreases, such as when idling, is large, or the like.

Furthermore, as the heretofore known apparatus shown in Patent Document 3 has a piping passage for supplying the fuel to the engine using only the upstream side pump, there has been a problem in that a piping configuration is complex, or the like.

SUMMARY OF THE INVENTION

The invention, having been contrived in order to solve the heretofore described kinds of problem in the heretofore known apparatus, has an object of providing a fuel supply system which can respond to a variable fuel pressure with a simple configuration.

According to a first aspect of the invention, a fuel supply system includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series. The low pressure fuel pump and high pressure fuel pump are configured in such a way as to be driven or stopped independently of each other, one by each motor. The pressure of the fuel discharged from the high pressure fuel pump is made variable by a combination of the drive or stop of the low pressure fuel pump and the drive or stop of the high pressure fuel pump.

Also, according to a second aspect of the invention, a fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by driving the low pressure fuel pump and driving the high pressure fuel pump.

Furthermore, according to a third aspect of the invention, a fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The pressure of the fuel discharged from the high pressure fuel pump is made the first predetermined pressure by driving the low pressure fuel pump and stopping the high pressure fuel pump. The pressure of the fuel discharged from the high pressure fuel pump is made a pressure wherein the first predetermined pressure and second predetermined pressure are added by driving the low pressure fuel pump and driving the high pressure fuel pump.

Also, according to a fourth aspect of the invention, a fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The high pressure fuel pump is configured in such a way as to be able to directly suction and discharge the fuel accumulated in the fuel tank when the low pressure fuel pump is stopped. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by stopping the low pressure fuel pump and driving the high pressure fuel pump. The pressure of the fuel discharged from the high pressure fuel pump is made a pressure wherein the first predetermined pressure and second predetermined pressure are added by driving the low pressure fuel pump and driving the high pressure fuel pump.

According to the fuel supply system of the first aspect of the invention, the low pressure fuel pump and high pressure fuel pump are configured in such a way as to be driven or stopped independently of each other, one by each motor, and the pressure of the fuel discharged from the high pressure fuel pump is made variable by a combination of the drive or stop of the low pressure fuel pump and the drive or stop of the high pressure fuel pump. Because of this arrangement, it is possible to obtain a fuel supply system which can respond to a variable fuel pressure with a simple configuration. Also, it is possible to select a pressure of fuel to be supplied, for example, when a key switch is activated before the engine is started.

Also, the fuel supply system according to the second aspect of the invention includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by driving the low pressure fuel pump and driving the high pressure fuel pump. Because of this arrangement, it is possible to obtain a fuel supply system which can respond to a variable fuel pressure with a simple configuration. Also, it is possible to select a pressure of fuel to be supplied, for example, when a key switch is activated before the engine is started.

Furthermore, the fuel supply system according to the third aspect of the invention includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The pressure of the fuel discharged from the high pressure fuel pump is made the first predetermined pressure by driving the low pressure fuel pump and stopping the high pressure fuel pump. The pressure of the fuel discharged from the high pressure fuel pump is made a pressure wherein the first predetermined pressure and second predetermined pressure are added by driving the low pressure fuel pump and driving the high pressure fuel pump. Because of this configuration, as well as it being possible to reduce the number of fuel pipes, it is possible, when driving the low pressure fuel pump and high pressure fuel pump, to supply a fuel pressure wherein a pressure set by the first pressure adjustment device and a pressure set by the second pressure adjustment device are added to the fuel injection valve, meaning that it is possible to lower a setting pressure, that is, adjustment pressure point of the second pressure adjustment device.

Also, the fuel supply system according to the fourth aspect of the invention includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The high pressure fuel pump is configured in such a way as to be able to directly suction and discharge the fuel accumulated in the fuel tank when the low pressure fuel pump is stopped. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by stopping the low pressure fuel pump and driving the high pressure fuel pump. The pressure of the fuel discharged from the high pressure fuel pump is made a pressure wherein the first predetermined pressure and second predetermined pressure are added by driving the low pressure fuel pump and driving the high pressure fuel pump. Because of this configuration, it is possible to obtain an intermediate fuel pressure. Also, it is possible to obtain a fuel supply system which can respond to a variable fuel pressure with a simple configuration. Also, it is possible to select a pressure of fuel to be supplied, for example, when a key switch is activated before the engine is started. Furthermore, it is possible to achieve a miniaturization, a reduction in power, an improvement in fuel efficiency, a simplification of fuel pipe arrangement, an improvement in vapor lock resistance, a reduction in cost, and the like, of the fuel supply system.

The foregoing and other object, features, aspects, and advantages of the present invention will become more apparent from the following detailed description of the present invention when taken in conjunction with the accompanying drawings.

DETAILED DESCRIPTION

First Embodiment

Figure 1:
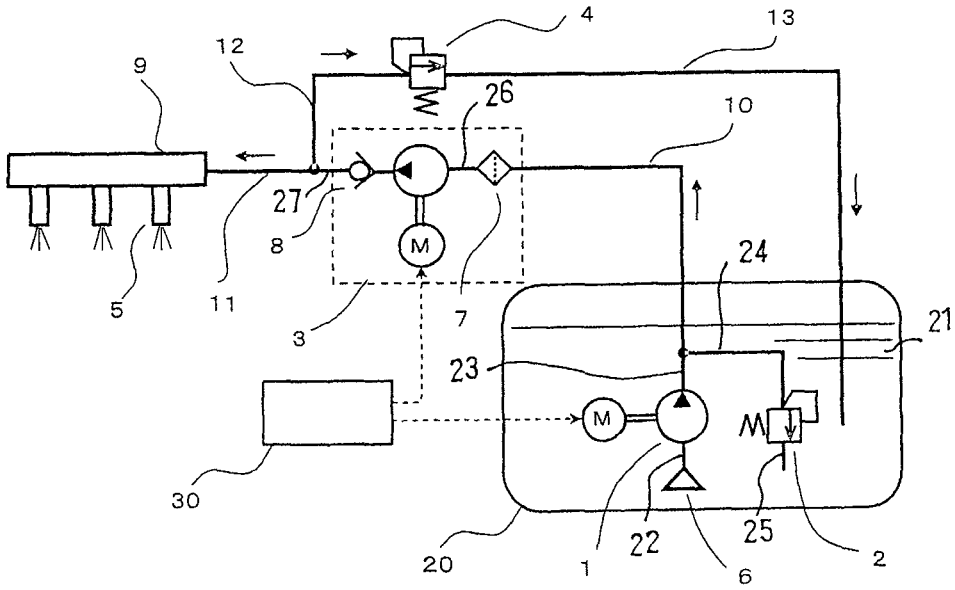
FIG. 1 is a hydraulic circuit diagram of a fuel supply system according to a first embodiment of the invention.

FIG. 1 is a hydraulic circuit diagram of a fuel supply system according to a first embodiment of the invention. In FIG. 1, a low pressure fuel pump 1 installed inside a fuel tank 20, being configured of, for example, a Wesco type fuel pump driven by a motor M, is immersed in a fuel 21 accumulated in the fuel tank 20. The low pressure fuel pump 1 discharges the fuel 21, suctioned therein from a fuel inlet 22 via a filter 6, from a fuel outlet 23.

A first pressure adjustment device 2 whose adjustment pressure is set to a predetermined low pressure, to be described hereafter, being installed inside the fuel tank 20, is immersed in the fuel 21. The first pressure adjustment device 2, being connected to the fuel outlet 23 of the low pressure fuel pump 1 via a connecting pipe 24, maintains the pressure of the fuel discharged from the low pressure fuel pump 1 at the predetermined low pressure to be described hereafter by returning one portion of the fuel discharged from the fuel outlet 24 into the fuel tank 20 via a return pipe 25 when the pressure of the fuel discharged from the low pressure fuel pump 1 exceeds a set predetermined pressure. The first pressure adjustment device 2 can be of a configuration of a known pressure adjustment device wherein the setting of a predetermined pressure is carried out using a spring.

A high pressure fuel pump 3 fixed to a structure or the like of a vehicle is a piston-driven fuel pump arranged in such a way that a piston pump is driven by a motor M, as will be described hereafter. A fuel inlet 26 of the high pressure fuel pump 3 is connected to the fuel outlet 23 of the low pressure fuel pump 1 via a filter 7 and a pump connecting pipe 10. Fuel pressurized by the piston pump of the high pressure fuel pump 3 is discharged from a fuel outlet 27 via a check valve 8.

A second pressure adjustment device 4, being connected to the fuel outlet 27 of the high pressure fuel pump 3 via a connecting pipe 12, maintains the pressure of the fuel discharged from the fuel outlet 27 of the high pressure fuel pump 3 at the predetermined high pressure to be described hereafter by returning one portion of the fuel discharged from the fuel outlet 27 into the fuel tank 20 via a fuel return pipe 13 when the pressure of the fuel discharged from the high pressure fuel pump 3 exceeds a predetermined high pressure to be described hereafter. The second pressure adjustment device 4 can be of a configuration of a known pressure adjustment device wherein the setting of a predetermined pressure is carried out using a spring.

A plurality of fuel injection valves 5, being provided corresponding to a plurality of cylinders of an engine (not shown), directly inject the fuel, supplied from the high pressure fuel pump 3 via a fuel discharge pipe 11 and a delivery pipe 9, into the combustion chambers of the corresponding cylinders. An engine control unit 30 carries out a drive control of the motor M of the low pressure fuel pump 1 and the motor M of the high pressure fuel pump 3 in response to an operation condition or operation purpose of the engine.

Figure 2:
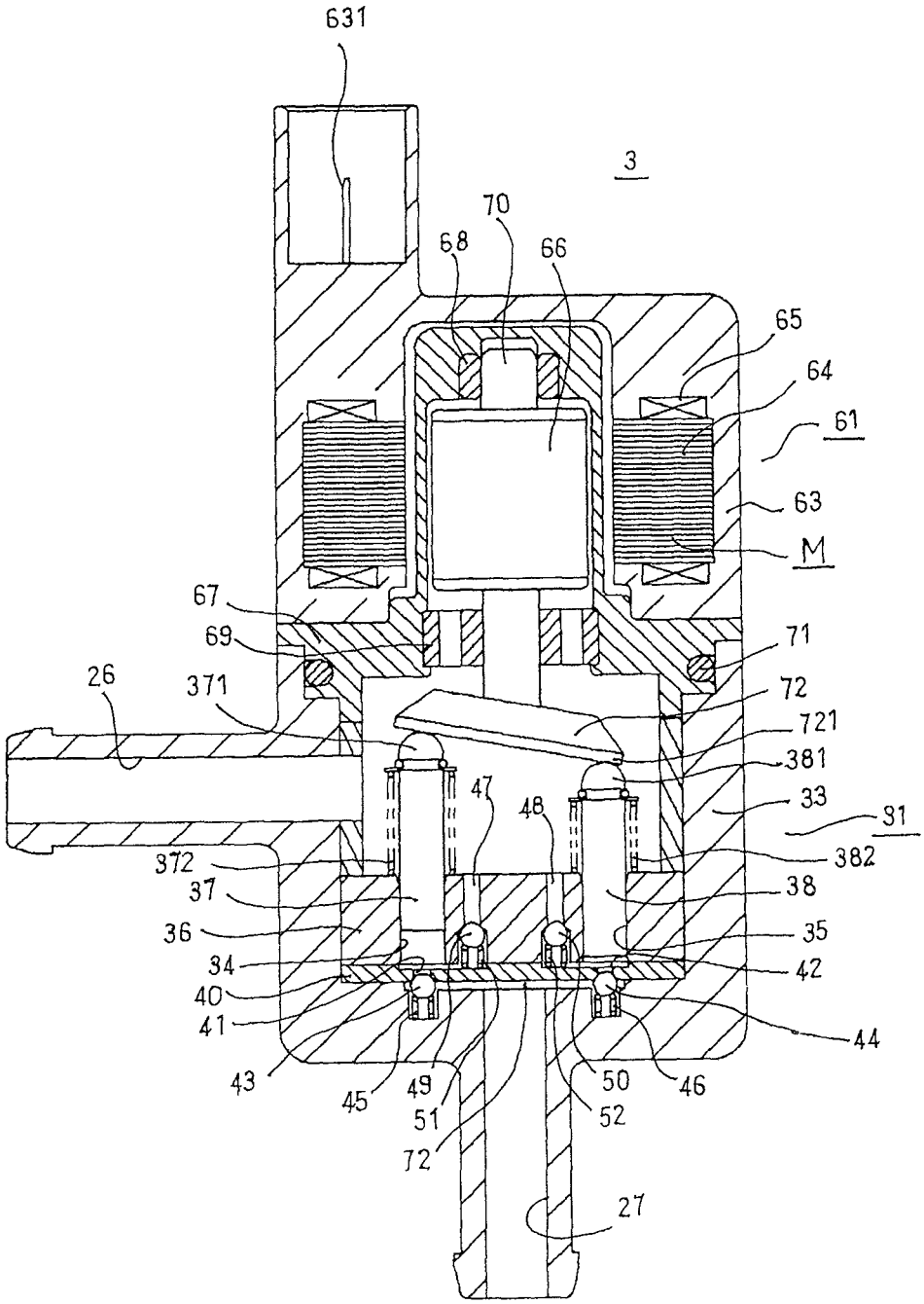
FIG. 2 is a sectional configuration diagram of a high pressure fuel pump in the fuel supply system according to the first embodiment of the invention.

Next, a description will be given of a configuration of the high pressure fuel pump 3. FIG. 2 is a sectional configuration diagram of the high pressure fuel pump in the fuel supply system according to the first embodiment of the invention. In FIG. 2, the high pressure fuel pump 3 is configured of a pump portion 31 and a motor portion 61. The pump portion 31 includes a pump portion housing 33 formed from a synthetic resin or the like, and a cylinder portion 36 including two cylinders 34 and 35 is fixed inside the pump portion housing 33. Two pistons 37 and 38, being inserted in the respective cylinders 34 and 35 of the cylinder portion 36, are configured so as to be slidable in an axial direction in the cylinders 34 and 35. The high pressure fuel pump in the first embodiment is configured including two each of the pistons 37 and 38 and cylinders 34 and 35, but the number of pistons and cylinders not being limited to this, it is sufficient to arrange so that a plurality of pistons and cylinders are evenly spaced on a perimeter.

Piston springs 372 and 382 configured of a compression spring, being mounted between tops 371 and 381 of the respective pistons 37 and 38 and one end face of the cylinder portion 36, always bias the corresponding pistons 37 and 38 in a direction away from the cylinder portion 36. A valve seat portion 40 formed in a circular plate form is installed between the other end face of the cylinder portion 36 and the inner wall of the pump portion housing 31. The valve seat portion 40 includes through holes 41 and 42 formed in positions corresponding to the cylinders 34 and 35. Valve bodies 43 and 44 formed in a ball form, being disposed between valve springs 45 and 46 mounted in the inner wall of the pump portion housing 31 and the through holes 41 and 42 of the valve seat portion 36 respectively, are always biased by valve springs 45 and 46 in a direction in which they close the through holes 41 and 42.

The valve seat portion 40 including the through holes 41 and 42, valve bodies 43 and 44, and valve springs 45 and 46 configure the check valve 8 in FIG. 1.

In the cylinder portion 36, two through holes 47 and 48 are formed on the central portion side thereof. Each of the through holes 47 and 48 is configured of a small diameter portion and a large diameter portion, and valve bodies 49 and 50 formed in a ball form are mounted one on each large diameter portion side. The valve bodies 49 and 50 are always biased by valve springs 51 and 52 in a direction in which they close the small diameter portions of the through holes 47 and 48. The through hole 47, by being released from being closed by the valve body 49, communicates with the through hole 41 of the valve seat portion 40 via the cylinder 34, and in the same way, the through hole 48, by being released from being closed by the valve body 50, communicates with the through hole 42 of the valve seat portion 40 via the cylinder 35.

The through holes 41 and 42 of the valve seat portion 40, by being released from being closed by the valve bodies 43 and 44, communicate with the fuel outlet 27 via a clearance 72 between the valve seat portion 40 and the inner wall of the pump portion housing 33. Also, the through holes 47 and 48 of the cylinder portion 36 are in communication with the fuel inlet 26 provided in the pump portion housing 33, via the inside of the pump portion housing 33 housing the pistons 37 and 38.

The motor portion 61 includes a motor portion housing 63 formed from a synthetic resin or the like, and the motor M configured of a direct current brushless motor is incorporated inside the motor portion housing 63. A stator core 64 of the motor M and a stator coil 65 wound around the stator core 64 are embedded inside the motor portion housing 63. A rotor 66 of the motor M, being provided inside a rotor support body 67 mounted inside the motor portion housing 63, is disposed in a position corresponding to the inner peripheral surface of the stator core 64. A lead connecting terminal portion 631 for supplying power to the motor portion M is provided in the motor portion housing 63.

The rotor support body 67 is clamped between the pump portion housing 33 and motor portion housing 63, and fixed integrally with them. Bearings 68 and 69, being fixed to the rotor support body 67, rotatably support a rotor shaft 70 fixed integrally to the rotor 66. The inside of the motor portion housing 63 and the inside of the pump portion housing 33 communicate with each other via the bearing 69, and the inside of the rotor support body 67, as well as the inside of the pump portion housing 33, is also filled with the fuel. Consequently, the rotor 66 is immersed in the fuel. A piston drive body 72 including an inclined surface 721 inclined in the axial direction, of which the central portion is fixed to one end portion of the rotor shaft 70, rotates together with the rotor shaft 70. A seal ring 71 is inserted between the rotor support body 67 and pump portion housing 33.

The inclined surface 721 of the piston drive body 72 is in slidable abutment with the top 371 of the piston 37 and the top of the piston 38. As the inclined surface 721 is inclined in the axial direction, the pistons 37 and 38 alternately repeat the operation of moving to the side opposite to the motor side against the biasing forces of the piston springs 372 and 382 by being pressed by the inclined surface 721, and the operation of moving to the motor side by means of the biasing forces of the piston springs 372 and 382, by the piston drive body 72 rotating together with the rotor shaft 70. FIG. 2 shows a condition in which the piston 37 has moved farthest to the motor side, and the piston 38 has moved farthest to the side opposite to the motor side.

With the fuel supply system according to the first embodiment of the invention configured in the way heretofore described, on the motor M of the low pressure fuel pump 1 being driven based on a command from the engine control unit 30, the fuel 21 in the fuel tank 20 is suctioned into the low pressure fuel pump 1 from the fuel inlet 22 via the filter 6, and discharged from the fuel outlet 23 to the pump connecting pipe 10. The pressure of the fuel discharged from the fuel outlet 23 of the low pressure fuel pump 1 is maintained at the predetermined low pressure set in the first pressure adjustment device 2.

On the motor M of the high pressure fuel pump 3 being driven based on a command from the engine control unit 30, as described using FIG. 2, the piston drive body 72 rotates and alternately drives the pistons 37 and 38 to the side opposite to the motor side (the lower direction of FIG. 2). The pistons 37 and 38, after being driven to the side opposite to the motor side by the piston drive body 72, alternately return to the motor side (the upper direction of the FIG. 2) by means of the piston springs 372 and 382. On the pistons 37 and 38 being driven to the side opposite to the motor side, the fuel filling the inside of the cylinders 34 and 35 is compressed to attain a high pressure, and the valve bodies 43 and 44 are depressed in the lower direction of FIG. 2 against the biasing forces of the valve springs 45 and 46.

By this means, the fuel in the cylinders 34 and 35 are discharged from the fuel outlet 27 via the clearance 72 through the through holes 41 and 42 of the valve seat portion 40. At this time, as the valve bodies 51 and 52 of the cylinder portion 36 close the through holes 47 and 48 of the cylinder portion 36 by means of the high pressure fuel in the cylinders 34 and 35, it does not happen that the high pressure fuel flows back into the pump portion housing 33. The pressure of the fuel discharged from the fuel outlet 27 of the high pressure fuel pump 3 is maintained at the predetermined high pressure set in the second pressure adjustment device 4. The fuel from the high pressure fuel pump, whose pressure is adjusted to the predetermined high pressure by the second pressure adjustment device 4, is supplied to the fuel injection valves 5 via the fuel discharge pipe 11 and delivery pipe 9. The fuel injection valves 5 directly inject the supplied fuel into the combustion chambers of the corresponding cylinders.

Herein, supposing that the high pressure fuel pump 3 is stopped when the low pressure fuel pump 1 is being driven, in FIG. 2, the operation of the pistons 37 and 38 of the high pressure fuel pump 3 stops, and the fuel is not pressurized to any higher pressure, but a low pressure fuel supplied from the low pressure fuel pump 1 into the pump portion housing 33 via the pump connecting pipe 10 and filter 7 is discharged from the fuel outlet 27 to the fuel discharge pipe 11 via the cylinders 34 and 35, and through holes 41 and 42, through the through holes 47 and 48 of the cylinder portion 36. Consequently, the fuel injection valves 5 inject the fuel of the predetermined low pressure adjusted by the first pressure adjustment device into the cylinders of the engine.

On the low pressure fuel pump 1 stopping, there is no more fuel supply to the high pressure fuel pump 3, and the fuel injection from the fuel injection valves 5 stops.

With the fuel supply system according to the first embodiment of the invention, a fuel based system is configured of the high pressure fuel pump 3, which is in a fuel pipe and fixed to a vehicle body frame or the like, the second pressure adjustment device 4 whose adjustment pressure is set to a high pressure, and the fuel injection valves 5 installed in the engine, wherein each of the low pressure fuel pump 1 installed in the fuel tank 20 and the high pressure fuel pump 3 fixed to the structure or the like of the vehicle is configured of a motor-driven fuel pump, and the low pressure fuel pump 1 and high pressure fuel pump 3 are driven independently of each other.

For example, when the adjustment pressure of the first pressure adjustment device 2 is set to a low pressure of 0.3 MPa, and the adjustment pressure of the second pressure adjustment device 4 is set to a high pressure of 1.0 MPa, it is possible to adopt the following drive pattern 1 or drive pattern 2.

Drive pattern 1

Low pressure fuel pump 1: ON (driven)

Adjustment pressure of first pressure adjustment device: 0.3 MPa

High pressure fuel pump 3: OFF (stopped)

Adjustment pressure of second pressure adjustment device: 1.0 MPa

Pressure of fuel supplied to fuel injection valves 5: 0.3 MPa
Drive pattern 2
Low pressure fuel pump 1: ON (driven)
Adjustment pressure of first pressure adjustment device: 0.3 MPa
High pressure fuel pump 3: ON (driven)
Adjustment pressure of second pressure adjustment device: 1.0 MPa
Pressure of fuel supplied to fuel injection valves 5: 1.0 MPa Also, as heretofore described, by causing the fuel discharged from the low pressure fuel pump 1 to always pass through the high pressure fuel pump 3, the fuel in the high pressure fuel pump 3 is already air-bled, meaning that there is no need for a particular air-bleeding operation, and it is possible to obtain a stable fuel pressure swiftly when the high pressure fuel pump 3 operates. For this reason, by the high pressure fuel pump 3 employing a piston pump which communicates from the fuel inlet 26 to the fuel outlet 27 when the fuel pump stops, and furthermore, employing an inner rotor type brushless DC motor with a small rotor inertia, it is possible to shorten the start-up time of the high pressure fuel pump 3.

A pressure loss occurring when the fuel is caused to pass through the high pressure fuel pump 3 can be held down to 10 kPa or less, and it is possible to ignore an effect on a fuel pressure caused by causing the fuel to pass through the high pressure fuel pump 3.

In the case of the fuel injection system according to the first embodiment of the invention, as a result of measuring a switching time of the fuel pressure, it has been confirmed that it is possible to switch the fuel pressure from the low pressure to the high pressure 0.1 seconds to 0.2 seconds after the high pressure fuel pump 3 has been operated.

It will be understood that the heretofore described fuel supply system according to the first embodiment of the invention is one in which the following aspects of the invention are embodied.

1. A fuel supply system includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series. The low pressure fuel pump and high pressure fuel pump are configured in such a way as to be driven or stopped independently of each other, one by each motor. The pressure of the fuel discharged from the high pressure fuel pump is made variable by a combination of the drive or stop of the low pressure fuel pump and the drive or stop of the high pressure fuel pump.

2. A fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by driving the low pressure fuel pump and driving the high pressure fuel pump.

With the fuel supply system, the first pressure adjustment device and second pressure adjustment device are configured in such a way as to return a return fuel subjected to the pressure adjustment to the fuel tank.

According to the fuel supply system of the first embodiment of the invention, it is possible to obtain a fuel supply system which can respond to a variable fuel pressure with a simple configuration. Also, it is possible to select a pressure of fuel to be supplied, for example, when a key switch is activated before the engine is started. Furthermore, it is possible to achieve a miniaturization, a reduction in power, an improvement in fuel efficiency, a simplification of fuel pipe arrangement, an improvement in vapor lock resistance, a reduction in cost, and the like, of the fuel supply system.

Second Embodiment

Figure 3:
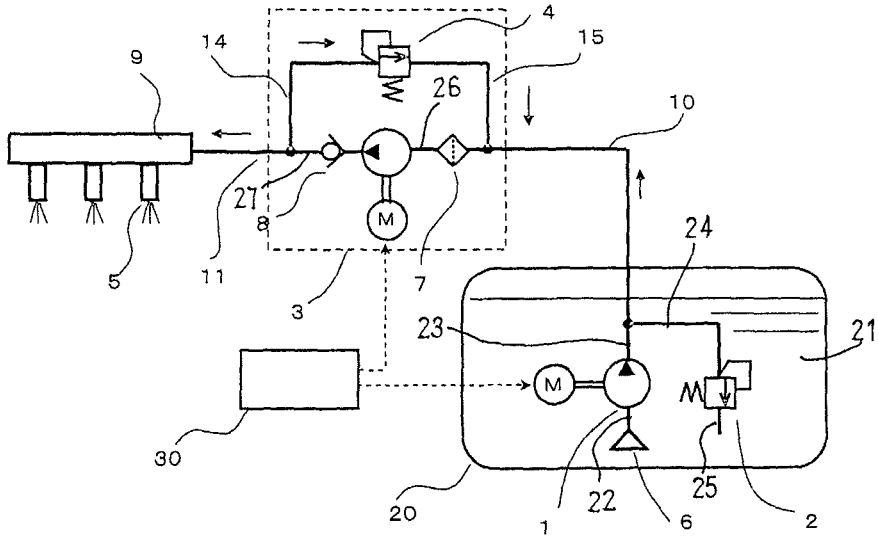
FIG. 3 is a hydraulic circuit diagram of a fuel supply system according to a second embodiment of the invention.

Next, a description will be given of a fuel supply system according to a second embodiment of the invention. FIG. 3 is a hydraulic circuit diagram of the fuel supply system according to the second embodiment of the invention. In the first embodiment, an arrangement is such that the fuel discharged from the second pressure adjustment device 4 is returned to the fuel tank 20 via the fuel return pipe 13, but in the case of the second embodiment shown in FIG. 3, a configuration is such that the second pressure adjustment device 4 is incorporated in the high pressure fuel pump 3, and the fuel discharged from the high pressure fuel pump 3 is returned to the fuel inlet 26 side of the high pressure fuel pump 3 by way of a low pressure communication passage 15. The other configuration is the same as that of the fuel supply system in the first embodiment.

That is, in FIG. 3, the second pressure adjustment device 4 is incorporated in the high pressure fuel pump 3, the fuel outlet 27 of the high pressure fuel pump 3 and the second pressure adjustment device 4 are caused to communicate by a high pressure communication passage 14, and furthermore, the second pressure adjustment device 4 and the fuel inlet 26 of the high pressure fuel pump 3 are caused to communicate by the low pressure communication passage 15. Because of this, as well as it being possible to reduce the number of fuel pipes, it is possible, when driving the low pressure fuel pump 1 and high pressure fuel pump 3, to supply the fuel injection valves 5 with a fuel pressure wherein a pressure set by the first pressure adjustment device 2 and a pressure set by the second pressure adjustment device 4 are added, meaning that it is possible to lower a setting pressure, that is, an adjustment pressure point of the second pressure adjustment device 4.

In the case of the fuel supply system according to the second embodiment of the invention, for example, the following drive pattern 1 or drive pattern 2 can be adopted.

Drive pattern 1
Low pressure fuel pump 1: ON (driven)
Adjustment pressure of first pressure adjustment device: 0.3 MPa
High pressure fuel pump 3: OFF (stopped)
Adjustment pressure of second pressure adjustment device: 0.7 MPa
Pressure of fuel supplied to fuel injection valves 5: 0.3 MPa Drive pattern 2

Low pressure fuel pump 1: ON (driven)

Adjustment pressure of first pressure adjustment device: 0.3 MPa

High pressure fuel pump 3: ON (driven)

Adjustment pressure of second pressure adjustment device: 0.7 MPa

Pressure of fuel supplied to fuel injection valves 5: 0.3+0.7=1.0 MPa

It will be understood that the heretofore described fuel supply system according to the second embodiment of the invention is one in which the following aspects of the invention are embodied.

1. A fuel supply system includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series. The low pressure fuel pump and high pressure fuel pump are configured in such a way as to be driven or stopped independently of each other, one by each motor. The pressure of the fuel discharged from the high pressure fuel pump is made variable by a combination of the drive or stop of the low pressure fuel pump and the drive or stop of the high pressure fuel pump.

2. A fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The pressure of the fuel discharged from the high pressure fuel pump is made the first predetermined pressure by driving the low pressure fuel pump and stopping the high pressure fuel pump. The pressure of the fuel discharged from the high pressure fuel pump is made a pressure wherein the first predetermined pressure and second predetermined pressure are added by driving the low pressure fuel pump and driving the high pressure fuel pump.

With the fuel supply system, the second pressure adjustment device is incorporated in the high pressure fuel pump.

According to the fuel supply system according to the second embodiment of the invention, as well as it being possible to reduce the number of fuel pipes, it is possible, when driving the low pressure fuel pump and high pressure fuel pump, to supply a fuel pressure wherein pressures set by the first pressure adjustment device and second pressure adjustment device are added, meaning that it is possible to lower the adjustment pressure point of the second pressure adjustment device. Also, it is possible to obtain a fuel supply system which can respond to a variable fuel pressure with a simple configuration. Also, it is possible to select a pressure of fuel to be supplied, for example, when a key switch is activated before the engine is started. Furthermore, it is possible to achieve a miniaturization, a reduction in power, an improvement in fuel efficiency, a simplification of fuel pipe arrangement, an improvement in vapor lock resistance, a reduction in cost, and the like, of the fuel supply system.

Third Embodiment

Figure 4:
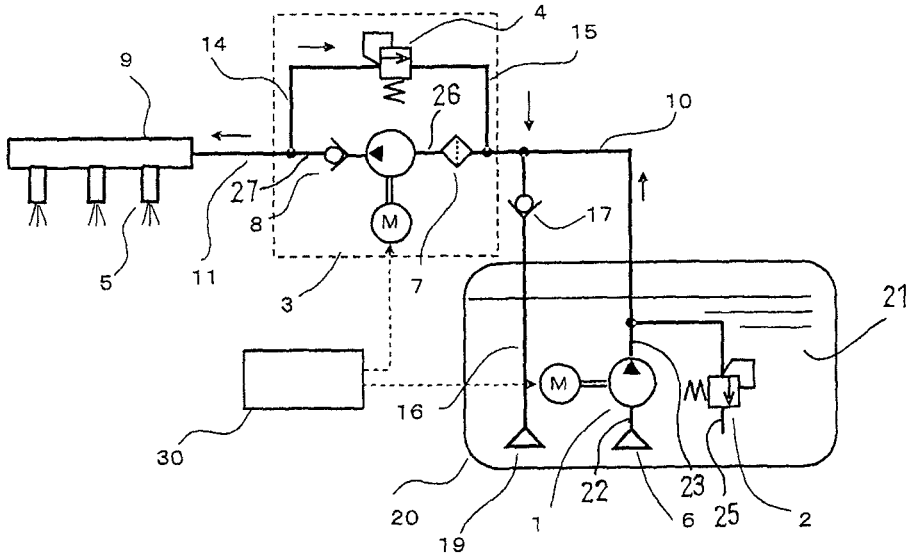
FIG. 4 is a hydraulic circuit diagram of a fuel supply system according to a third embodiment of the invention.

Next, a description will be given of a fuel supply system according to a third embodiment of the invention. FIG. 4 is a hydraulic circuit diagram of the fuel supply system according to the third embodiment of the invention. In the case of the third embodiment, a configuration is such that a bypass pipe 16 having the check valve 17 is provided partway along the pump connecting pipe 10 which connects the low pressure fuel pump 1 and high pressure fuel pump 3 and, by causing the bypass pipe 16 to communicate with the fuel tank 20, it is possible to stop the low pressure fuel pump 1 and cause only the high pressure fuel pump 3 to operate. The other configuration is the same as that of the fuel supply system according to the second embodiment.

In FIG. 4, on the low pressure fuel pump 1 being stopped, and the high pressure fuel pump 3 being driven, the fuel 21 in the fuel tank 20 passes through the check valve 17 from the bypass pipe 16 via the filter 19, and is suctioned by the fuel inlet 26 of the high pressure fuel pump 3. Because of this, it is possible to supply a high pressure fuel to the fuel injection valves 5 using solely the high pressure fuel pump 3. The reason for providing the check valve 17 in the bypass pipe 16 is to prevent the fuel from the low pressure fuel pump 1 from returning into the fuel tank 20 when the low pressure fuel pump 1 is driven.

In the case of the fuel supply system according to the third embodiment of the invention, for example, the following drive pattern 1, drive pattern 2, or drive pattern 3 can be adopted.

Drive pattern 1

Low pressure fuel pump 1: ON (driven)

Adjustment pressure of first pressure adjustment device: 0.3 MPa

High pressure fuel pump 3: OFF (stopped)

Adjustment pressure of second pressure adjustment device: 0.7 MPa

Pressure of fuel supplied to fuel injection valves 5: 0.3 MPa

Drive pattern 2

Low pressure fuel pump 1: OFF (stopped)

Adjustment pressure of first pressure adjustment device: 0.3 MPa

High pressure fuel pump 3: ON (driven)

Adjustment pressure of second pressure adjustment device: 0.7 MPa

Pressure of fuel supplied to fuel injection valves 5: 0.7 MPa

Drive pattern 3

Low pressure fuel pump 1: ON (driven)

Adjustment pressure of first pressure adjustment device: 0.3 MPa

High pressure fuel pump 3: ON (driven)

Adjustment pressure of second pressure adjustment device: 0.7 MPa

Pressure of fuel supplied to fuel injection valves 5: 0.3+0.7=1.0 MPa

It will be understood that the heretofore described fuel supply system according to the third embodiment of the invention is one in which the following aspects of the invention are embodied.

1. A fuel supply system includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series. The low pressure fuel pump and high pressure fuel pump are configured in such a way as to be driven or stopped independently of each other, one by each motor. The pressure of the fuel discharged from the high pressure fuel pump is made variable by a combination of the drive or stop of the low pressure fuel pump and the drive or stop of the high pressure fuel pump.

2. A fuel supply system, which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, includes a first pressure adjustment device which adjusts the pressure of the fuel discharged from the low pressure fuel pump to a first predetermined pressure, and a second pressure adjustment device which adjusts the pressure of the fuel discharged from the high pressure fuel pump to a second predetermined pressure higher than the first predetermined pressure. The low pressure fuel pump and high pressure fuel pump are configured in such a way as to be driven or stopped independently of each other, one by each motor. The second pressure adjustment device is such that a passage through which a return fuel subjected to the pressure adjustment is caused to flow is caused to communicate with a fuel inlet side of the high pressure fuel pump. The high pressure fuel pump is configured in such a way as to be able to directly suction and discharge the fuel accumulated in the fuel tank when the low pressure fuel pump is stopped. The pressure of the fuel discharged from the high pressure fuel pump is made the first predetermined pressure by driving the low pressure fuel pump and stopping the high pressure fuel pump. The pressure of the fuel discharged from the high pressure fuel pump is made the second predetermined pressure by stopping the low pressure fuel pump and driving the high pressure fuel pump. The pressure of the fuel discharged from the high pressure fuel pump is made a pressure wherein the first predetermined pressure and second predetermined pressure are added by driving the low pressure fuel pump and driving the high pressure fuel pump.

With the fuel supply system, the high pressure fuel pump is configured in such a way as to be able to directly suction the fuel, accumulated in the fuel tank when the low pressure fuel pump is stopped, through a bypass pipe connected to the fuel tank via the check valve.

According to the fuel supply system of the third embodiment of the invention, it is possible to obtain an intermediate fuel pressure, as heretofore described. Also, it is possible to obtain a fuel supply system which can respond to a variable fuel pressure with a simple configuration. Also, it is possible to select a pressure of fuel to be supplied, for example, when a key switch is activated before the engine is started. Furthermore, it is possible to achieve a miniaturization, a reduction in power, an improvement in fuel efficiency, a simplification of fuel pipe arrangement, an improvement in vapor lock resistance, a reduction in cost, and the like, of the fuel supply system.

With the fuel supply systems in the first to third embodiments of the invention, the high pressure fuel pump is configured in such a way that it, when stopped, can bypass and discharge the fuel discharged from the low pressure fuel pump. Also, the high pressure fuel pump, being configured of a piston-driven fuel pump including a piston which is driven by the motor to pressurize the suctioned fuel, is configured in such a way as to cause the fuel discharged from the low pressure fuel pump to always pass through the high pressure fuel pump.

Furthermore, with the fuel supply systems in the first to third embodiments of the invention, the motor which drives the high pressure fuel pump is an inner rotor type brushless DC motor.

Although a description has been given of the high pressure fuel pump in the first to third embodiment as being of a configuration such that it includes two each of the pistons 37 and 38, and cylinders 34 and 35, the number of pistons and cylinders not being limited to this, it is sufficient that a plurality of pistons and cylinders are evenly spaced on a perimeter. In this case, it goes without saying that piston springs, through holes of a valve seat portion, valve bodies, valve springs, and the like, are provided corresponding to the individual pistons and cylinders.

Various modifications and alterations of this invention will be apparent to those skilled in the art without departing from the scope and spirit of this invention, and it should be understood that this is not limited to the illustrative embodiments set forth herein.

What is claimed is:

1. A fuel supply system comprising:

a low pressure fuel pump which suctions and discharges fuel accumulated in a fuel tank; and a high pressure fuel pump which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, wherein the low pressure fuel pump and high pressure fuel pump are configured in such a way as to be driven or stopped independently of each other, one by each motor, wherein as a result of the high pressure fuel pump being stopped, the fuel is not pressurized to a higher pressure and the fuel being discharged from the high pressure fuel pump is at a pressure of the low pressure fuel pump, and the pressure of the fuel discharged from the high pressure fuel pump is made variable by a combination of the drive or stop of the low pressure fuel pump and the drive or stop of the high pressure fuel pump, wherein the high pressure fuel pump is located outside the fuel tank.

2. The fuel supply system according to claim 1, wherein the high pressure fuel pump, being configured of a piston-driven fuel pump including a piston which is driven by the motor to pressurize the suctioned fuel, is arranged such that the fuel discharged from the low pressure fuel pump always passes through the high pressure fuel pump.

3. The fuel supply system according to claim 1, wherein the motor which drives the high pressure fuel pump is an inner rotor type brushless DC motor.

4. A fuel supply system which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, comprising:

a first pressure adjustment device which adjusts the pressure of the fuel discharged from the low pressure fuel pump to a first predetermined pressure; and a second pressure adjustment device which adjusts the pressure of the fuel discharged from the high pressure fuel pump to a second predetermined pressure higher than the first predetermined pressure, wherein the low pressure fuel pump and high pressure fuel pump are configured in such a way as to be driven or stopped independently of each other, one by each motor, the pressure of the fuel discharged from the high pressure fuel pump is made the first predetermined pressure by driving the low pressure fuel pump and stopping the high pressure fuel pump, and the pressure of the fuel discharged from the high pressure fuel pump is made the second predetermined pressure by driving the low pressure fuel pump and driving the high pressure fuel pump, wherein the high pressure fuel pump is located outside the fuel tank, wherein as a result of the high pressure fuel pump being stopped, the fuel is not pressurized to a higher pressure and the fuel being discharged from the high pressure fuel pump is at a pressure of the low pressure fuel pump.

5. The fuel supply system according to claim 4, wherein the high pressure fuel pump, being configured of a piston-driven fuel pump including a piston which is driven by the motor to pressurize the suctioned fuel, is arranged such that the fuel discharged from the low pressure fuel pump always passes through the high pressure fuel pump.

6. The fuel supply system according to claim 4, wherein the first pressure adjustment device and second pressure adjustment device are configured in such a way as to return a return fuel subjected to the pressure adjustment to the fuel tank.

7. A fuel supply system which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, comprising:

a first pressure adjustment device which adjusts the pressure of the fuel discharged from the low pressure fuel pump to a first predetermined pressure; and a second pressure adjustment device which adjusts the pressure of the fuel discharged from the high pressure fuel pump to a second predetermined pressure higher than the first predetermined pressure, wherein the low pressure fuel pump and high pressure fuel pump are configured in such a way as to be driven or stopped independently of each other, one by each motor, the second pressure adjustment device is such that a passage through which a return fuel subjected to the pressure adjustment is caused to flow is caused to communicate with a fuel inlet side of the high pressure fuel pump, the pressure of the fuel discharged from the high pressure fuel pump is made the first predetermined pressure by driving the low pressure fuel pump and stopping the high pressure fuel pump, and the pressure of the fuel discharged from the high pressure fuel pump is made a pressure wherein the first predetermined pressure and second predetermined pressure are added by driving the low pressure fuel pump and driving the high pressure fuel pump, wherein as a result of the high pressure fuel pump being stopped, the fuel is not pressurized to a higher pressure and the fuel being discharged from the high pressure fuel pump is at a pressure of the low pressure fuel pump.

8. The fuel supply system according to claim 7, wherein wherein the high pressure fuel pump, being configured of a piston-driven fuel pump including a piston which is driven by the motor to pressurize the suctioned fuel, is arranged such that the fuel discharged from the low pressure fuel pump always passes through the high pressure fuel pump.

9. The fuel supply system according to claim 7, wherein the second pressure adjustment device is incorporated in the high pressure fuel pump.

10. A fuel supply system which includes a low pressure fuel pump, which suctions and discharges fuel accumulated in a fuel tank, and a high pressure fuel pump, which suctions and discharges the fuel discharged from the low pressure fuel pump and supplies the fuel to a fuel injection valve installed in an internal combustion engine, the low pressure fuel pump, high pressure fuel pump, and fuel injection valve being connected in series, comprising:

a first pressure adjustment device which adjusts the pressure of the fuel discharged from the low pressure fuel pump to a first predetermined pressure; and a second pressure adjustment device which adjusts the pressure of the fuel discharged from the high pressure fuel pump to a second predetermined pressure higher than the first predetermined pressure, wherein the low pressure fuel pump and high pressure fuel pump are configured in such a way as to be driven or stopped independently of each other, one by each motor, the second pressure adjustment device is such that a passage through which a return fuel subjected to the pressure adjustment is caused to flow is caused to communicate with a fuel inlet side of the high pressure fuel pump, the high pressure fuel pump is configured in such a way as to be able to directly suction and discharge the fuel accumulated in the fuel tank when the low pressure fuel pump is stopped, the pressure of the fuel discharged from the high pressure fuel pump is made the first predetermined pressure by driving the low pressure fuel pump and stopping the high pressure fuel pump, the pressure of the fuel discharged from the high pressure fuel pump is made the second predetermined pressure by stopping the low pressure fuel pump and driving the high pressure fuel pump, and the pressure of the fuel discharged from the high pressure fuel pump is made a pressure wherein the first predetermined pressure and second predetermined pressure are added by driving the low pressure fuel pump and driving the high pressure fuel pump, wherein as a result of the high pressure fuel pump being stopped, the fuel is not pressurized to a higher pressure and the fuel being discharged from the high pressure fuel pump is at a pressure of the low pressure fuel pump.

11. The fuel supply system according to claim 10, wherein wherein the high pressure fuel pump, being configured of a piston-driven fuel pump including a piston which is driven by the motor to pressurize the suctioned fuel, is arranged such that the fuel discharged from the low pressure fuel pump always passes through the high pressure fuel pump.

12. The fuel supply system according to claim 10, wherein the high pressure fuel pump is configured in such a way as to be able to directly suction the fuel, accumulated in the fuel tank when the low pressure fuel pump is stopped, through a bypass pipe connected to the fuel tank via a check valve.

* * * * *